US007982578B2

(12) United States Patent
Buettner

(10) Patent No.: US 7,982,578 B2
(45) Date of Patent: Jul. 19, 2011

(54) SWITCH DISCONNECTOR

(75) Inventor: Alex Buettner, Roedental (DE)

(73) Assignee: Wöhner GmbH & Co. KG, Elektrotechnische Systeme, Rödental (DE)

( * ) Notice: Subject to any disclaimer, the term of this patent is extended or adjusted under 35 U.S.C. 154(b) by 198 days.

(21) Appl. No.: 12/383,664

(22) Filed: Mar. 25, 2009

(65) Prior Publication Data

US 2009/0243786 A1 Oct. 1, 2009

(30) Foreign Application Priority Data

Apr. 1, 2008 (DE) ..... 10 2008 016 648
Apr. 1, 2008 (DE) ..... 20 2008 004 467 U

(51) Int. Cl.
*H01H 85/22* (2006.01)
*H01H 85/32* (2006.01)
*H01H 85/48* (2006.01)
*H01H 85/20* (2006.01)

(52) U.S. Cl. ..... 337/196; 337/194; 337/205; 337/208; 337/209; 337/211; 361/642; 361/646; 361/626; 361/837

(58) Field of Classification Search ..... 337/194, 337/196, 205, 211, 203, 208, 209; 361/642, 361/626, 646, 837; 439/157, 620.26, 620.29, 439/620.34, 893, 620.3
See application file for complete search history.

(56) References Cited

U.S. PATENT DOCUMENTS 1,966,716 A * 7/1934 Green ..... 337/194
2,072,729 A * 3/1937 Corbett ..... 337/196
2,186,813 A * 1/1940 Adam et al. ..... 337/210
2,289,122 A * 7/1942 Jackson et al. ..... 337/188
3,030,474 A * 4/1962 Scott, Jr. ..... 337/7
3,202,788 A * 8/1965 George ..... 337/194
3,358,100 A * 12/1967 Schleicher ..... 337/194
3,379,842 A * 4/1968 Downs et al. ..... 337/146
4,778,959 A * 10/1988 Sabatella et al. ..... 218/1
(Continued)

FOREIGN PATENT DOCUMENTS

DE 1076775 B 3/1960
(Continued)

OTHER PUBLICATIONS

Jun. 11, 2010, Search Report from European Patent Office, in EP 09 15 5851, which is the publication of the European priority application for this U.S. application.

(Continued)

*Primary Examiner* — Anatoly Vortman
(74) *Attorney, Agent, or Firm* — Kolisch Hartwell, P.C.

(57) ABSTRACT

The present invention relates to a switch disconnector comprising a housing portion, in which several pairs of blade receiving contacts assigned to each other or the like are arranged, which can be bridged by means of fuses, possibly comprising shock protection covers at least partially covering contact blades, and comprising a lid for receiving said fuses, which is provided in a manner hinged to the housing portion, wherein several receiving means in the form of slots, grooves or the like are formed at the inside of the lid, wherein one bearing cage is provided per fuse, and each bearing cage comprises a cage portion for inserting a fuse, wherein the cage portion is fit to the shape of the fuse to be inserted, and each bearing cage is provided with fasteners, which can be inserted in and snapped into predetermined receiving means for fastening the bearing cage to the lid respectively.

14 Claims, 10 Drawing Sheets

U.S. PATENT DOCUMENTS

| | | | | |
|---|---|---|---|---|
| 4,851,963 | A * | 7/1989 | Miller et al. | 361/643 |
| 4,966,561 | A * | 10/1990 | Norden | 439/620.34 |
| 5,406,449 | A * | 4/1995 | Hicks et al. | 361/616 |
| 5,559,662 | A * | 9/1996 | Happ et al. | 361/104 |
| 5,831,228 | A * | 11/1998 | Kuki et al. | 200/16 E |
| 5,833,484 | A * | 11/1998 | Post et al. | 439/352 |
| 5,842,560 | A * | 12/1998 | Kuki et al. | 200/43.05 |
| 5,847,338 | A * | 12/1998 | Kuki et al. | 200/17 R |
| 5,973,418 | A * | 10/1999 | Ciesielka et al. | 307/130 |
| 6,157,287 | A * | 12/2000 | Douglass et al. | 337/198 |
| 6,317,312 | B1 * | 11/2001 | Hashizawa et al. | 361/642 |
| 6,325,647 | B1 * | 12/2001 | May et al. | 439/157 |
| 6,333,846 | B1 * | 12/2001 | Hashizawa et al. | 361/649 |
| 6,366,449 | B1 * | 4/2002 | Hashizawa et al. | 361/642 |
| 6,407,656 | B1 * | 6/2002 | Konda et al. | 337/194 |
| 6,587,028 | B2 * | 7/2003 | Mollet et al. | 337/194 |
| 6,650,222 | B2 * | 11/2003 | Darr et al. | 337/187 |
| 6,717,505 | B1 * | 4/2004 | Bruchmann | 337/194 |
| 6,727,797 | B1 * | 4/2004 | Bruchmann | 337/210 |
| 6,736,655 | B2 * | 5/2004 | Martin et al. | 439/157 |
| 6,784,783 | B2 * | 8/2004 | Scoggin et al. | 337/194 |
| 6,853,289 | B2 * | 2/2005 | Scoggin | 337/194 |
| 6,997,725 | B2 * | 2/2006 | Stella et al. | 439/157 |
| 6,998,954 | B2 * | 2/2006 | Milanczak | 337/194 |
| 7,355,503 | B2 * | 4/2008 | Buettner | 337/211 |
| 7,474,194 | B2 * | 1/2009 | Darr et al. | 337/72 |
| 7,561,017 | B2 * | 7/2009 | Darr et al. | 337/79 |
| 7,750,789 | B2 * | 7/2010 | Titokis et al. | 337/194 |
| 2003/0199184 | A1 * | 10/2003 | Martin et al. | 439/157 |
| 2005/0098419 | A1 * | 5/2005 | Matsui et al. | 200/311 |
| 2007/0235313 | A1 | 10/2007 | Maguire et al. | |
| 2008/0242150 | A1 * | 10/2008 | Chikamatsu et al. | 439/620.3 |
| 2009/0231082 | A1 | 9/2009 | Buettner | |
| 2009/0246992 | A1 * | 10/2009 | Martin | 439/157 |

FOREIGN PATENT DOCUMENTS

| | | | |
|---|---|---|---|
| DE | 76 07 074 | U | 9/1976 |
| DE | 94 03 039 | | 9/1994 |
| DE | 197 07 606 | | 10/1997 |
| DE | 10 2005 032210 | | 3/2006 |
| DE | 10 2006 022374 | | 11/2007 |
| DE | 102007053535 | A1 * | 5/2009 |
| FR | 2 620 567 | | 3/1989 |
| FR | 2 720 549 | | 12/1995 |
| FR | 2877138 | A1 * | 4/2006 |

OTHER PUBLICATIONS

Nov. 7, 2008, Office Action from German Patent Office, in DE 10 2008 016 648.0-34, which is the priority German application of this U.S. application.

* cited by examiner

SWITCH DISCONNECTOR

BACKGROUND

The invention relates to a switch disconnector.

Switch disconnectors are for example known from DE 10 2006 022 374 A1. Such a switch disconnector consists of at least one housing portion including blade receiving contacts assigned to each other for receiving fuse pairs, namely a number of pairs corresponding to the number of poles. In addition, the respective pairs of blade receiving contacts are provided along the axis of the housing portion and parallel to the axis of the housing portion respectively and serve to receive the contact blades of the fuses.

In such switch disconnectors, shock protection covers are preferably used, which at least partially overlap the blade receiving contacts so that, except for the slots for contacting the blade receiving contacts by the contact blades of the fuses, all remaining electrically conductive portions are covered. The housing portion is provided with a lid pivotally hinged thereto. At its upper surface, the lid comprises a translucent or transparent cover, preferably made of plastics, through which it can be seen whether fuses are inserted and possibly have fused. At the inside of the lid there are receiving means, which are provided to mount the individual fuses to the lower surface of the lid so that the fuses are mountable to the lid in a steady state and are correspondingly carried along when pivoting the lid. A fuse load switch with the housing portion is preferably attached to conductor rails by means of an adapter. The adapter for receiving the switch disconnector may be designed so that it can receive the housing portion with a variable input direction.

Such switch disconnectors serve for application and use with IEC fuses, for example type 60269, as they are common in Europe.

In the USA, cylinder fuses of the type UL, class J, are used. The cylinder fuses according to the UL standard are removed from and inserted into the lower part of another fuse by means of insulated pliers or the like respectively so that in case of a three-pole arrangement of fuses, for example, said fuses have to be arranged with a correspondingly large distance to each other in order to enable encompassing the respective fuse on both sides by means of insulated pliers or the like for the purpose of inserting and removing the fuses respectively.

SUMMARY

The invention is based on the object to design a switch disconnector of the kind mentioned initially so that fuses according to the UL standard with a space requirement as small as possible can be used and, at the same time, both the insertion and removal of the fuses without any difficulty is ensured.

According to the invention, said object is achieved by a switch disconnector comprising a housing portion, in which several pairs of blade receiving contacts assigned to each other or the like are arranged, which can be bridged by means of fuses, possibly comprising shock protection covers at least partially covering the contact blades, and comprising a lid for receiving said fuses, which is provided in a manner hinged to the housing portion, wherein several receiving means in the form of slots, grooves or the like are formed at the inside of the lid. One bearing cage is provided per fuse, with each bearing cage comprising a cage portion for inserting a fuse, and wherein the cage portion is fit to the shape of the fuse to be inserted. Each bearing cage is provided with fasteners, which can be inserted in and snapped into predetermined receiving means for fastening the bearing cage to the lid respectively.

Further embodiments of the invention result from the dependent claims.

The switch disconnector according to the invention is equipped with respectively one bearing cage, which serves to receive a cylinder fuse according to the UL standard, per fuse. Each bearing cage is fit to the external shape of the relevant fuse. With respect to cylinder fuses according to the UL standard, each bearing cage comprises a cage portion having an inner diameter being slightly larger than the standard diameter of such fuses for compensating diameter tolerances of the cylindrical fuses.

Each bearing cage is provided with fasteners bracing from the bearing cage and serving to insert the bearing cage at the inside of the lid into corresponding receiving means, for example in the form of slots, grooves or the like.

In a preferred embodiment, the cage portion is cylindrically formed and comprises on one side an insertion hole and on the opposite side a boundary wall. The boundary wall is provided with a slot for leading through one of the contact blades of the fuse. Furthermore, the boundary wall can be provided with ventilation slots.

In another embodiment, the bearing cage is formed in the area of the insertion hole of the cage portion with extended side portions serving to extend the path of the creeping current, for possibly occurring creeping currents, in order to avoid creeping currents between neighbouring bearing cages and fuses inserted therein.

In another embodiment, the cage portion is provided with an intermediate housing portion, at which the fasteners are formed. The intermediate housing portion particularly serves to define the cage portion at a specified distance to the inside of the lid in order to ensure an accurate insertion of the contact blades of the fuses into the associated blade receiving contacts of the housing portion in the operating state, i.e. to position the blade portions of the fuses as accurate as possible opposite the blade receiving contacts.

In a preferred embodiment, the intermediate housing portion is provided with ventilation slots and in addition comprises an approximately quadrangular opening, through which it is possible to look at the fuses from the upper surface of the lid.

In another embodiment, the bearing cage is provided in the area of the insertion hole with a locking means, which serves to fix the relevant fuse in order to prevent the fuse from moving out of the cage portion. The locking means is preferably nose-shaped and supported in a guiding means to be adjustable in a direction perpendicular to the axis of the bearing cage.

In another embodiment, the cage portion is provided with a ring arranged at least partially circumferentially, the outer diameter of which is larger than the outer diameter of the cage portion. When using several cage portions on the available space in the housing portion, such a configuration serves to enable a contact between neighbouring cage portions only in the area of the ring portions, whereby the distance between neighbouring fuses is configured as large as possible in order to avoid creeping currents.

The switch disconnector of a preferred embodiment is provided with an intermediate housing portion, in which a well is arranged for receiving a display means serving to display the operating state of the inserted fuse. Said display means is advantageously designed so that the display means lights up or flashes in case of a defective or burnt-out fuse.

In a preferred embodiment of the switch disconnector, the display means is formed by at least one light emitting diode arranged on a printed circuit board, wherein the well for receiving the display means, but not the display means itself (e.g., in the form of a light emitting diode), is covered by a cover so that the display means comes to be located above the cover plate and is therefore easily visible from outside.

In another embodiment, the fasteners of the bearing cages are integrated in a handle connecting the two fasteners with each other. In this embodiment the handle portion is inserted into the receiving means.

BRIEF DESCRIPTION OF THE DRAWINGS

A preferred embodiment of the switch disconnector according to the invention will be described below by means of the drawings, in which.

DETAILED DESCRIPTION

Figure 1:
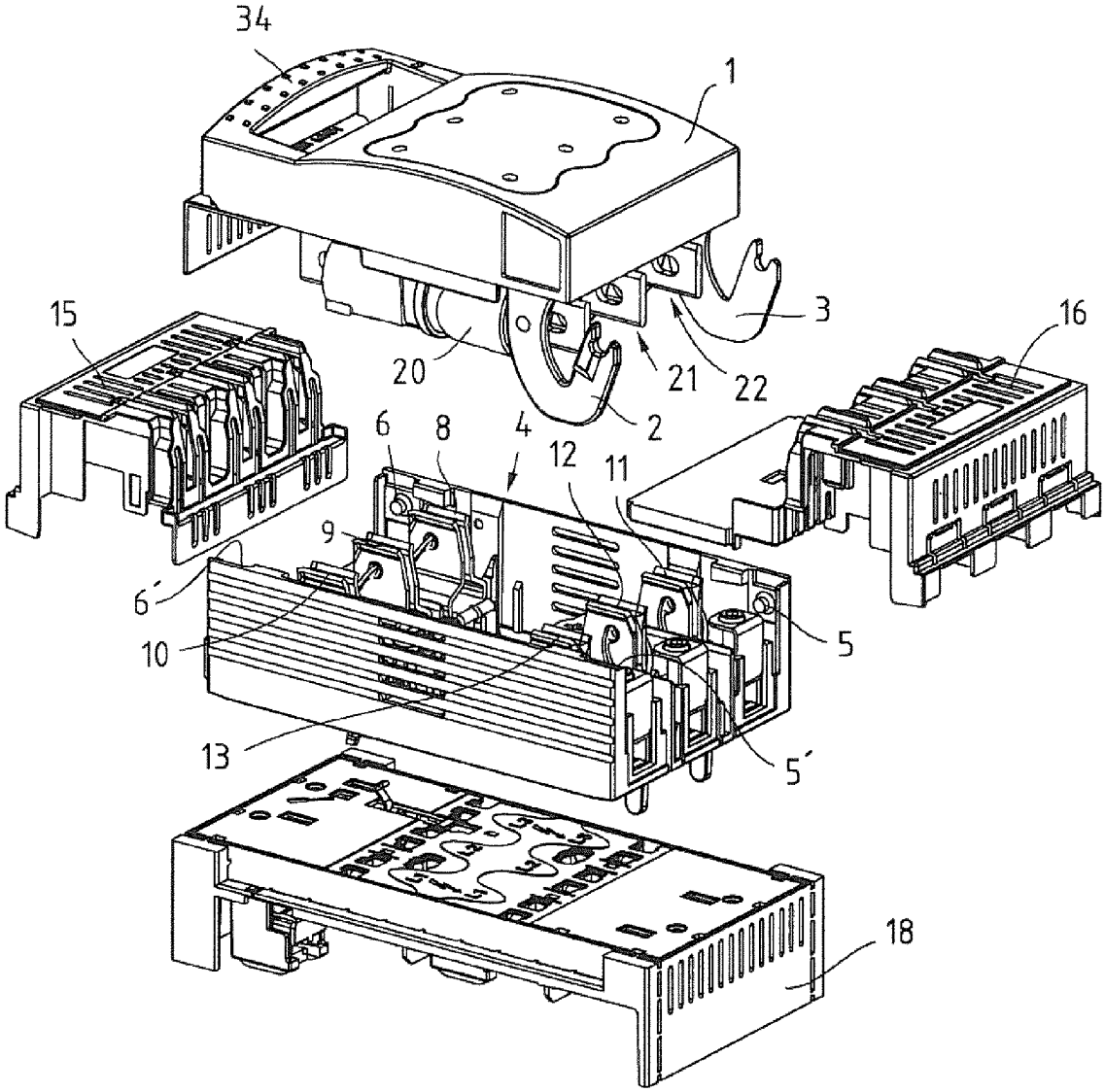
FIG. 1 is an exploded view of a preferred embodiment of a switch disconnector.

In FIG. 1, a preferred embodiment of a switch disconnector is illustrated. The switch disconnector comprises a lid, one end of which is provided with bearing feet and swivel feet 2, 3 respectively. The lid 1 is mounted onto a housing portion 4, wherein its swivel feet 2, 3 are attached to bearing pins 5, 5', 6, 6' formed on the housing portion 4, which according to FIG. 1 are provided in pairs and opposite each other at the inner walls of the housing portion 4. Thus the lid 1 can be mounted to the housing portion 4 in the direction shown in FIG. 1 or in a state rotated by 180°, wherein in the first case the swivel feet 2, 3 are attached to the fastening pins 5, 5', whereas they are attached to the fastening pins 6, 6' when the lid 1 is rotated by 180°.

In a switch disconnector according to FIG. 1, blade receiving contacts 8, 9, 10 and 11, 12, 13 respectively are provided in the housing portion 4 in accordance with the desired number of poles. The blade receiving contacts 8, 11; 9, 12 and 10, 13 respectively face each other, wherein each pair 8, 11 etc. serves to receive a fuse. In a preferred embodiment said blade receiving contacts 8 to 13 are covered by shock protection covers 15, 16 and to the extent that only slots for inserting the contact blades of the respective fuse remain open. An adapter 18 provided with counter-contacts, which are brought into electrical contact with the output contacts of the blade receiving contacts 8 to 13, is preferably used to attach the housing portion 4 onto conductor rails, not illustrated. This is not further illustrated in FIG. 1.

Said lid 1 serves to mount fuses, which are indicated by 20, 21, 22 in FIG. 1.

Figure 2:
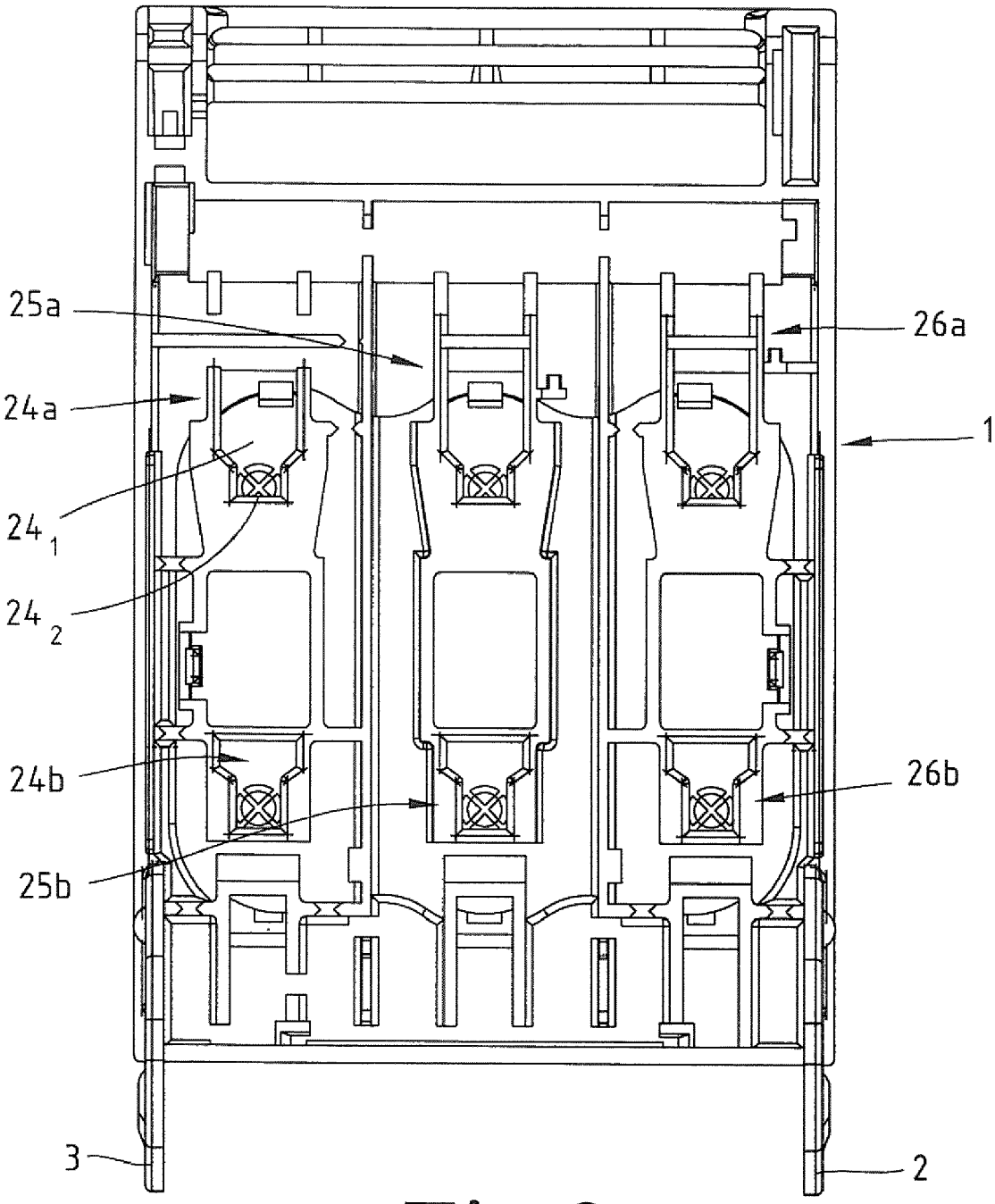
FIG. 2 is a bottom view of the lid of the switch disconnector without fuses.

FIG. 2 shows a bottom view of said lid 1 with said guiding means, which in the preferred embodiment according to FIG. 2 consist of respectively three pairs of receiving slots 24*a*, 24*b*, 25*a*, 25*b* and 26*a*, 26*b* in case of a three-pole switch disconnector. In the illustrated embodiment said receiving slots consist of respectively one receiving hole 241 comprising a tapered slot portion 242 adjacent thereto (refer to FIG. 2) so that the fasteners of each bearing cage, which are still to be described, can be inserted into said receiving means at the same time until they are fixedly attached to said lid 1.

Figure 3:
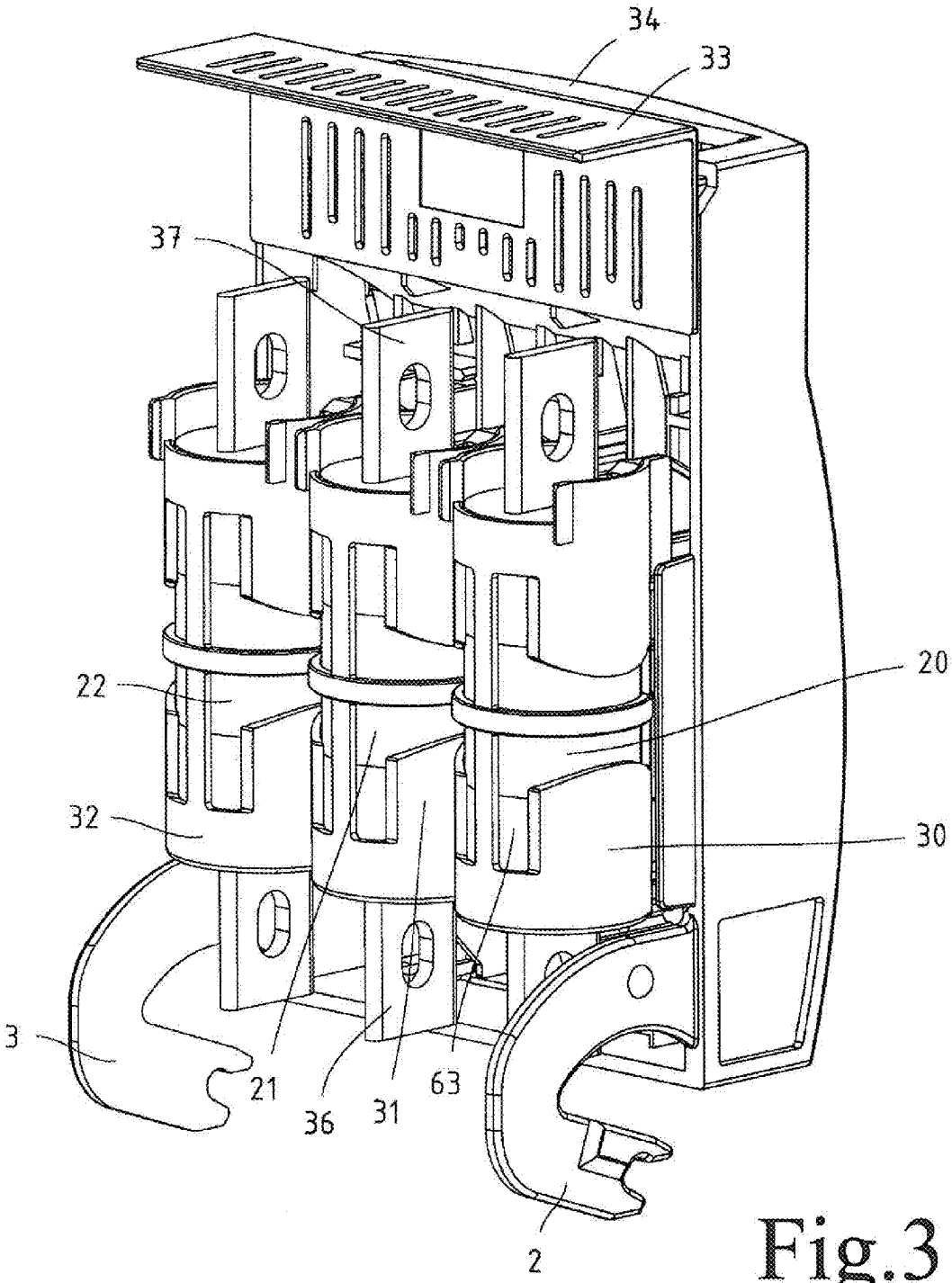
FIG. 3 is a view corresponding to FIG. 2 with fuses and bearing cages.

FIG. 3 shows a view corresponding to FIG. 2 with inserted fuses. FIG. 2 shows the fuses 20 to 22, of which each fuse 20 to 22 is inserted into respectively one bearing cage 30, 31, 32. The bearing cages are described in detail below. At the front end face of said lid 1 there is a shock protection 33, which preferably has the shape of a L-shaped plate and when gripping said lid 1 by a hoop 34 provided there prevents the fingers from being able to access the housing portion 4 below the hoop.

From FIG. 3 it is apparent that the bearing cages 30, 31, 32 are placed parallel to each other at the lower surface of said lid 1 and are provided closely next to each other, i.e. in a way saving space, when receiving the fuses 20 to 22.

Figure 4:
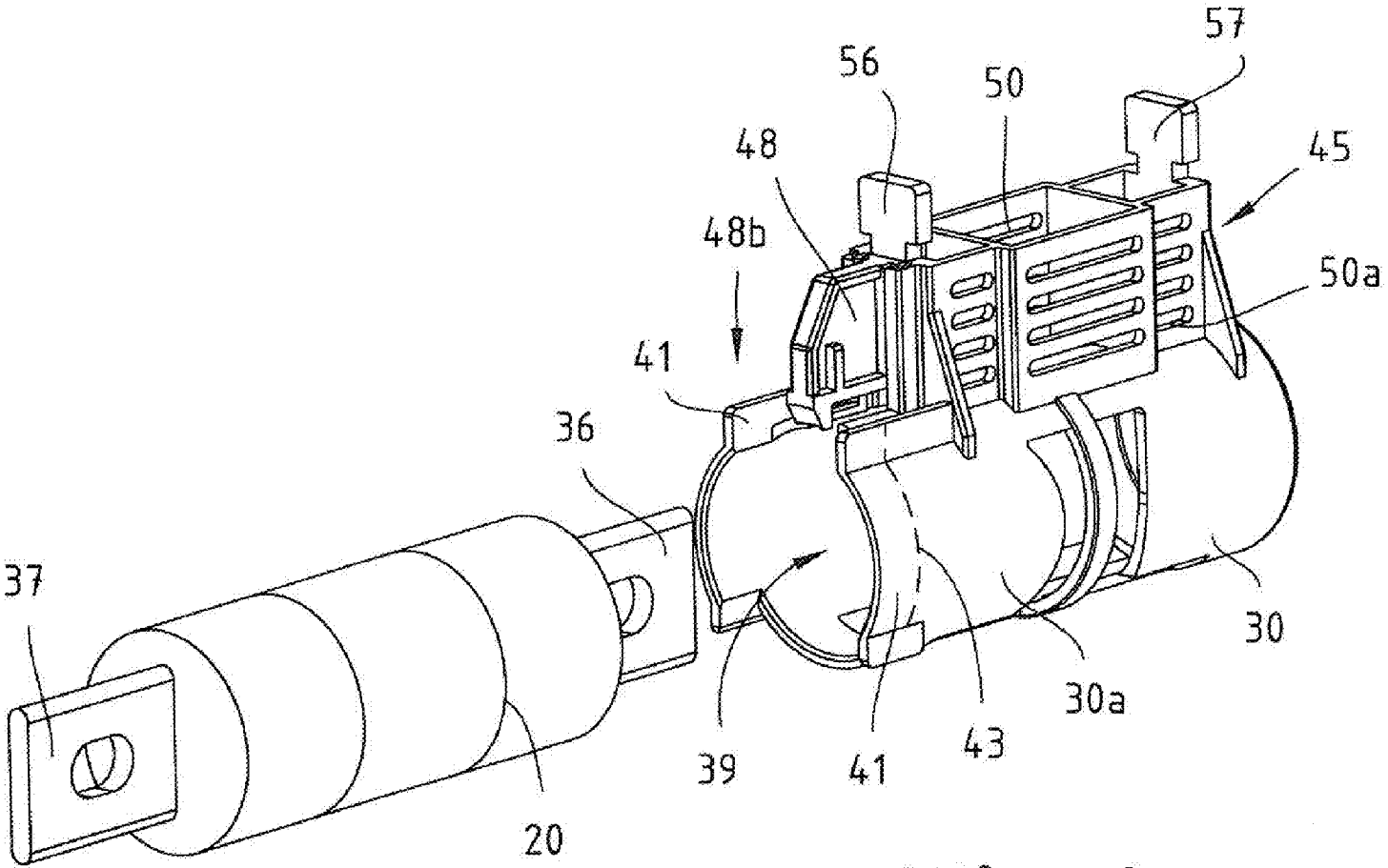
FIG. 4 is an illustration of a bearing cage and a fuse according to the UL standard.

FIG. 4 shows an illustration of a bearing cage designated by 30 and a fuse, which is designated by 20, according to the UL standard. Fuses according to the UL standard have a cylindrical shape and contact blades 36, 37 bracing laterally, which are brought into electrical contact with the blade receiving contacts 8 to 13 according to FIG. 1. Said bearing cage 30 comprises a cage portion 30*a*, which is to a great extent cylindrically formed and fit to the external shape of the fuse 20 respectively and comprises an inner diameter being slightly larger than the outer diameter of said fuse 20. The bearing cage 30 as well as the bearing cages 31, 32, which are correspondingly formed, comprise an insertion hole 39, via which the fuses 20, 21, 22 can respectively be inserted into the bearing cages 30, 31, 32. On the side of the insertion hole 39, the cage portion 30*a* is preferably provided with extended arms 40, 41. The dashed line in FIG. 4, which is designated by 43, shows the extension of the arms 40, 41 beyond the cage portion 30*a*. The extension owing to the arms 40, 41 causes a good insulation of neighbouring fuses to be effected and, in particular, the length of creeping current paths between neighbouring fuses to be enlarged so that creeping currents between neighbouring fuses are avoided.

An intermediate housing portion 45 is adjacent to the cage portion 30. Said intermediate housing portion 45 preferably includes slotted walls, wherein the slots in the walls of the intermediate housing portion serve for ventilation purposes to radiate heat, which is released from the respective fuse during operation.

Said intermediate housing portion 45 in particular serves to arrange the cage portion 30*a* at a height with respect to said lid 1 so that the contact blades 36, 37 of the respective fuses 20, 21, 22 are accurately inserted into the blade receiving contacts 8 to 13 when said lid 1 is closed. That is, said intermediate housing portion 45 is to ensure a predetermined spacing of said cage portion 30*a* with respect to the inner wall of the lid.

Figure 5:
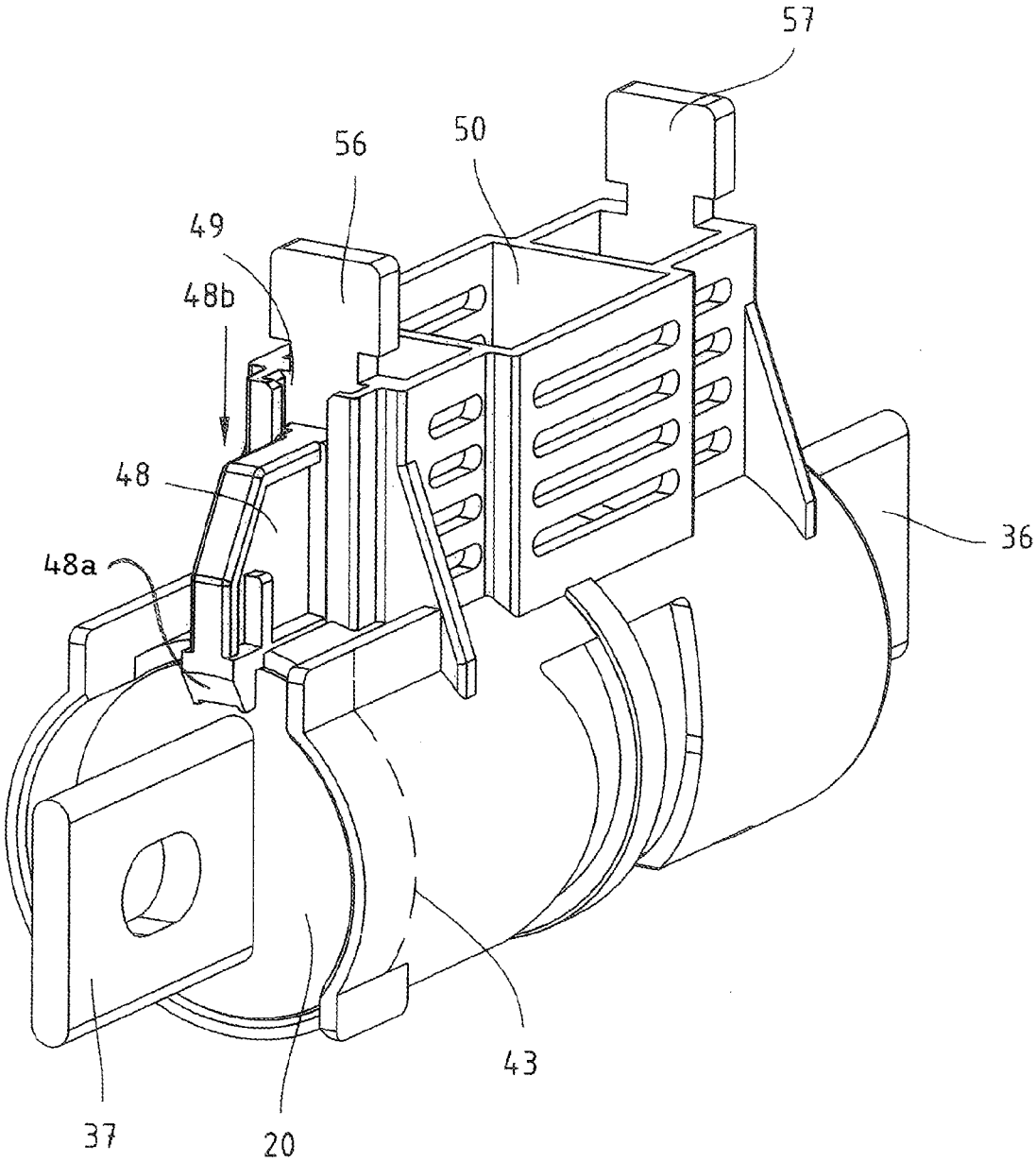
FIG. 5 is an illustration of a bearing cage with an inserted fuse.

According to FIG. 4, the bearing cage 30 comprises a locking means 48 preferably in the form of a displaceable bar, a nose 48*a* or the like, which is displaceable at right angles to the axis of the bearing cage 30 in the intermediate housing portion or at the intermediate housing portion 45. In FIGS. 4 and 5, the locking means 48 is moved downwards in the direction of the arrow 48*b* as soon as the relevant fuse 20 is inserted into the cage portion and prevents the fuse from automatically moving or being pushed out of the cage portion 30*a*. For this purpose, the locking means 48 is guided in a guiding groove 49 or the like at the intermediate housing portion 45, and is moved downwards by means of a spring, not illustrated, or the own weight into the position shown in FIG. 5, in which the locking means 48 overlaps the relevant fuse 20 by a nose 48*a*.

In the illustrated embodiment, the guiding groove 49 is preferably provided along the fastener 56.

In the illustrated embodiment, said intermediate housing portion 45 consists of walls, which are preferably slotted, and in addition define an opening cross section 50, via which the respective fuse 20, 21, 22 can be looked at from the outside of the lid. In this way it can be ascertained whether a fuse has fused and a fuse exists in the bearing cage respectively.

Figure 6:
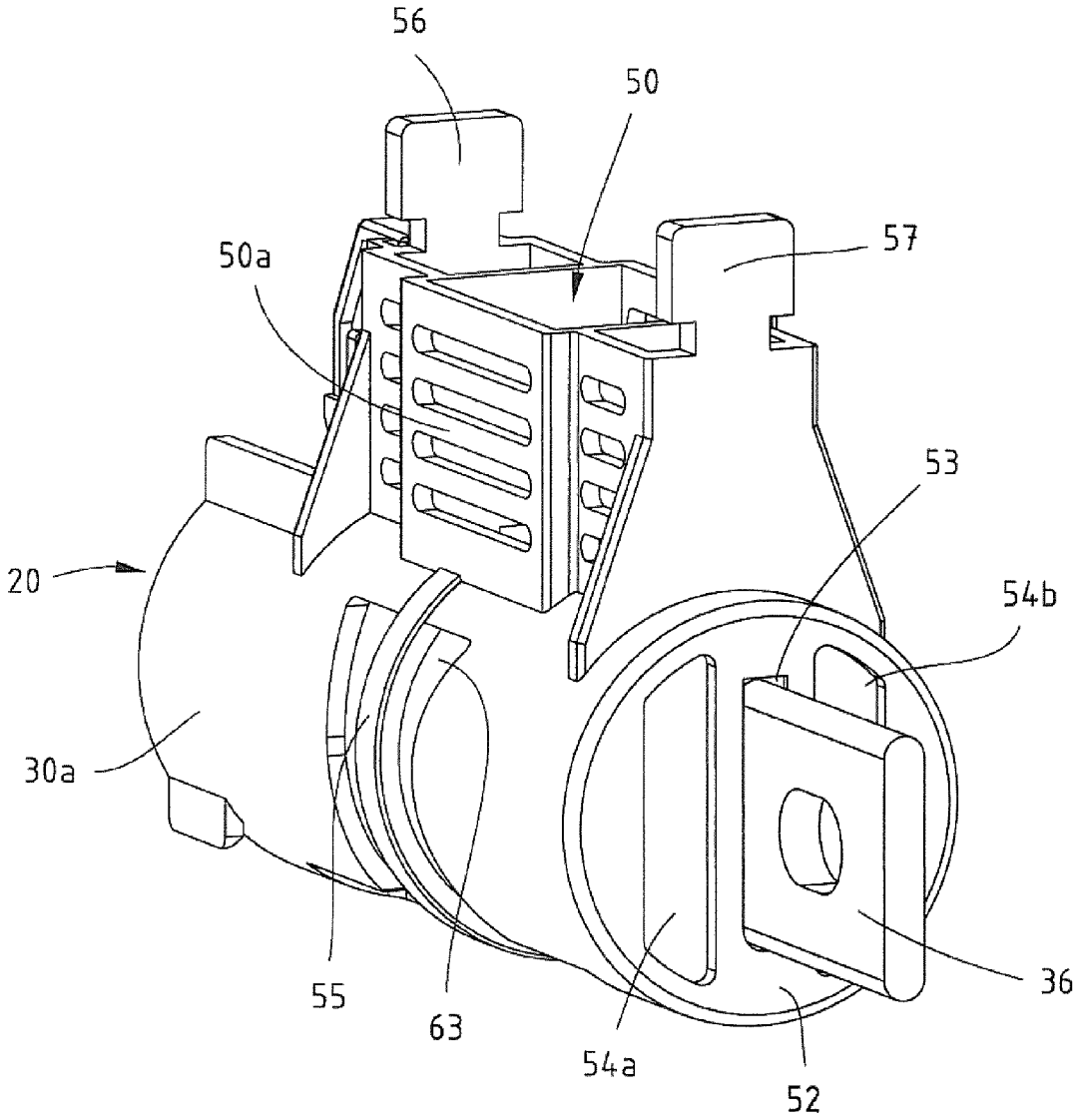
FIG. 6 is a rear view of the bearing cage corresponding to FIG. 5.

FIG. 6 shows a rear view of the bearing cage 30. At the back, the cage portion 30*a* is provided with a wall 52, which closes the cage portion 30*a* to the back. In the illustrated embodiment, said wall 52 is provided with a receiving slot 53 extending vertically and therefore perpendicularly to said lid 1 (refer to FIG. 3, for example), through which said contact blade 36 of a fuse 20 can be led through. In this way, it is ensured that said contact blade 36 is located perpendicularly to the axis of the cage portion 30*a* and therefore parallel to the blade receiving contacts, i.e., due to the lead-through slot 53, said fuse 20 is inserted into the bearing cage 30 in its operating position. By means of the receiving slot 53 it is ensured that said fuse is completely inserted into said cage portion 30*a* only in its correct position. Said fuse 20 can only be locked by the locking means 48 if said contact blade 36 projects completely from said receiving slot 53.

From FIGS. 4 to 6 it is further apparent that a ring 55, provided in an approximately centered and circumferential manner, is arranged at said cage portion 30*a*. Said ring 55 has an outer diameter being larger than the outer diameter of said cage portion 30. In case of a parallel arrangement of the bearing cages 30 to 32 according to FIG. 3, and at the same time in case of contact of said bearing cages, it is therefore ensured that the neighbouring bearing cages contact each other only via said ring 55 but not via the walls of the bearing cages. It is therefore ensured that the path of the creeping current is defined by each ring 55 and that creeping currents between neighbouring fuses can be prevented.

In the illustrated embodiment, a guiding means in the form of fasteners 56, 57 is formed at each bearing cage preferably above and at the free end of the intermediate housing portion 45 respectively. Said fasteners 56, 57 are respectively approximately T-shaped and serve to be correspondingly inserted into the receiving slots 24*a* to 26*b*.

The guiding components and fasteners 56, 57 respectively are preferably parallel in axial direction of the bearing cage 30 to 32 and spaced from each other. According to a preferred embodiment, the preferably quadrangular opening cross section 50 of the well designated by 50*a* is located between the fasteners 56, 57 projecting beyond said well 50*a*.

By the illustrated formation of the bearing cages, it is thus possible to remove each of the fuses 20, 21, 22 separately and manually from the lid 1 of the switch disconnector once the lid 1 is opened, without the use of tools being required for this. After removing the bearing cages, the fuses can be pushed out of the bearing cages. In order to insert the fuses, the procedure is reversed.

In a preferred embodiment of the bearing cage 30 to 32, through holes or openings 62, 63 are advantageously formed in the center region of the walls thereof for the release of heat radiated from the fuses. The opening 62 is substantially aligned with the opening cross section 50.

Figure 7:
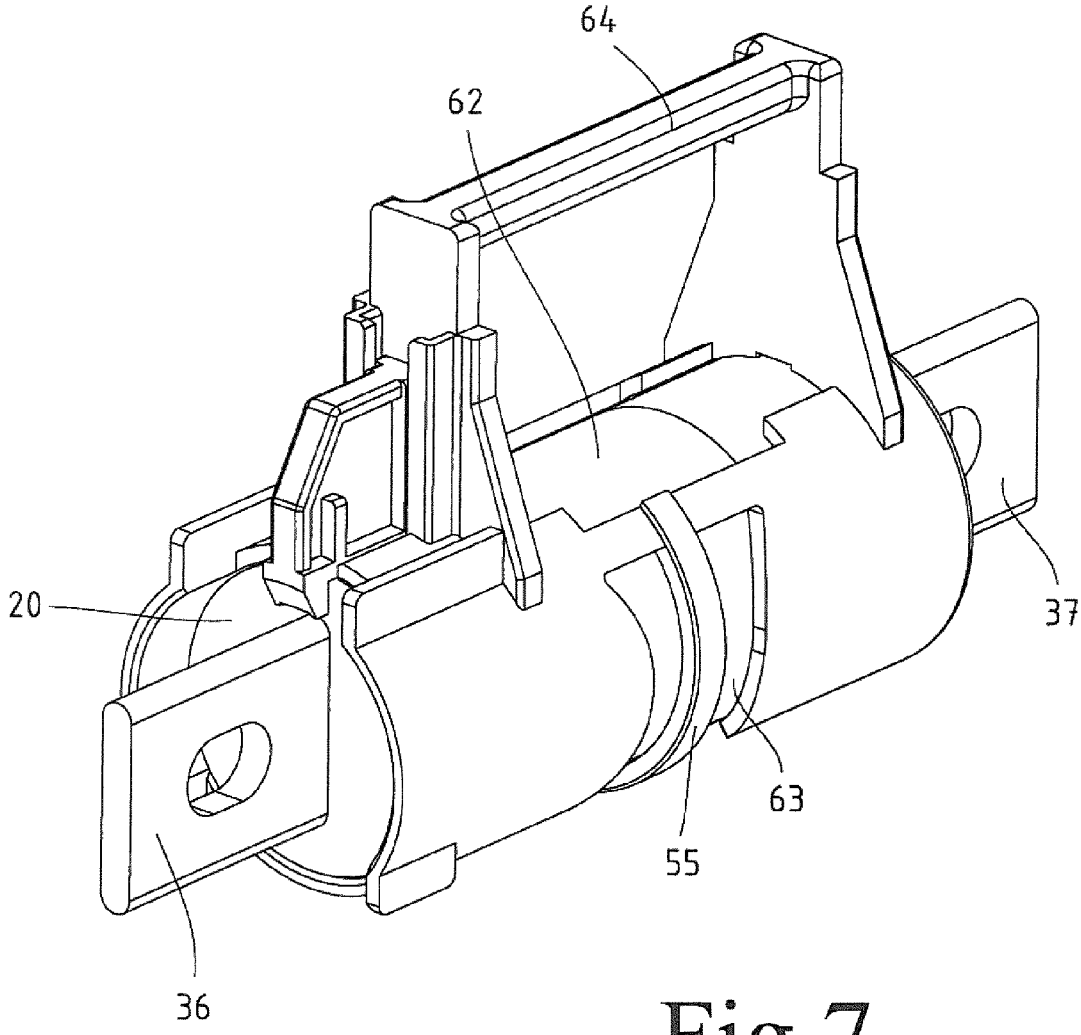
FIG. 7 is a perspective view of a bearing cage with an inserted fuse according to another modification.

FIG. 7 shows another embodiment of a bearing cage, in which the fasteners 56, 57 include a handle designated by 64. Here, said handle 64 forms a connection of the fasteners 56, 57 according to FIGS. 4 to 6. The handle allows for manually removing the individual bearing cages 30, 31, 32 with the fuses at the switch disconnector, if the bearing cages are not inserted into the lid 1 contrary to the preceding embodiments.

Figure 8:
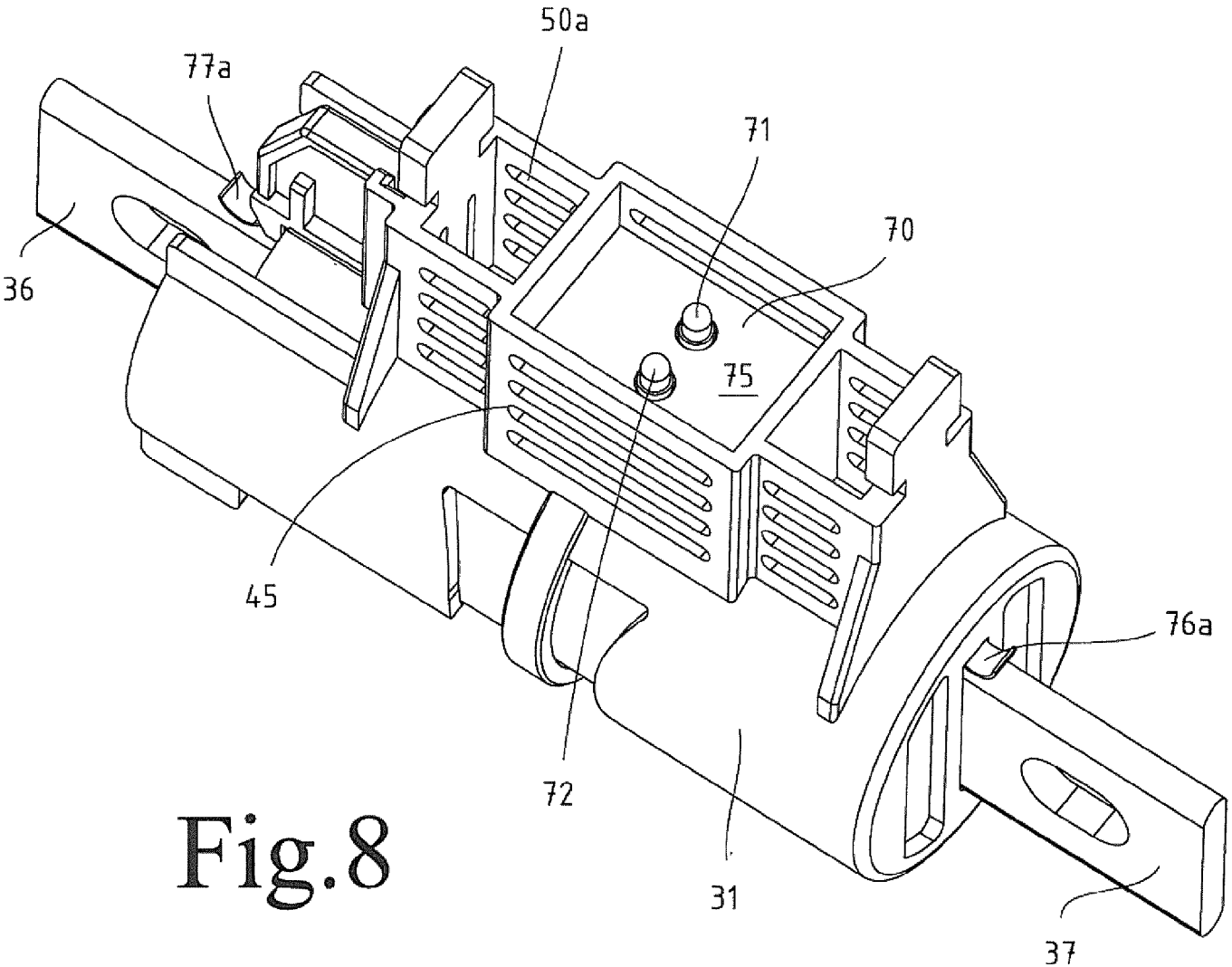
FIG. 8 is a perspective view of a bearing cage with a display means for displaying the operating state of the associated fuse.
Figure 9:
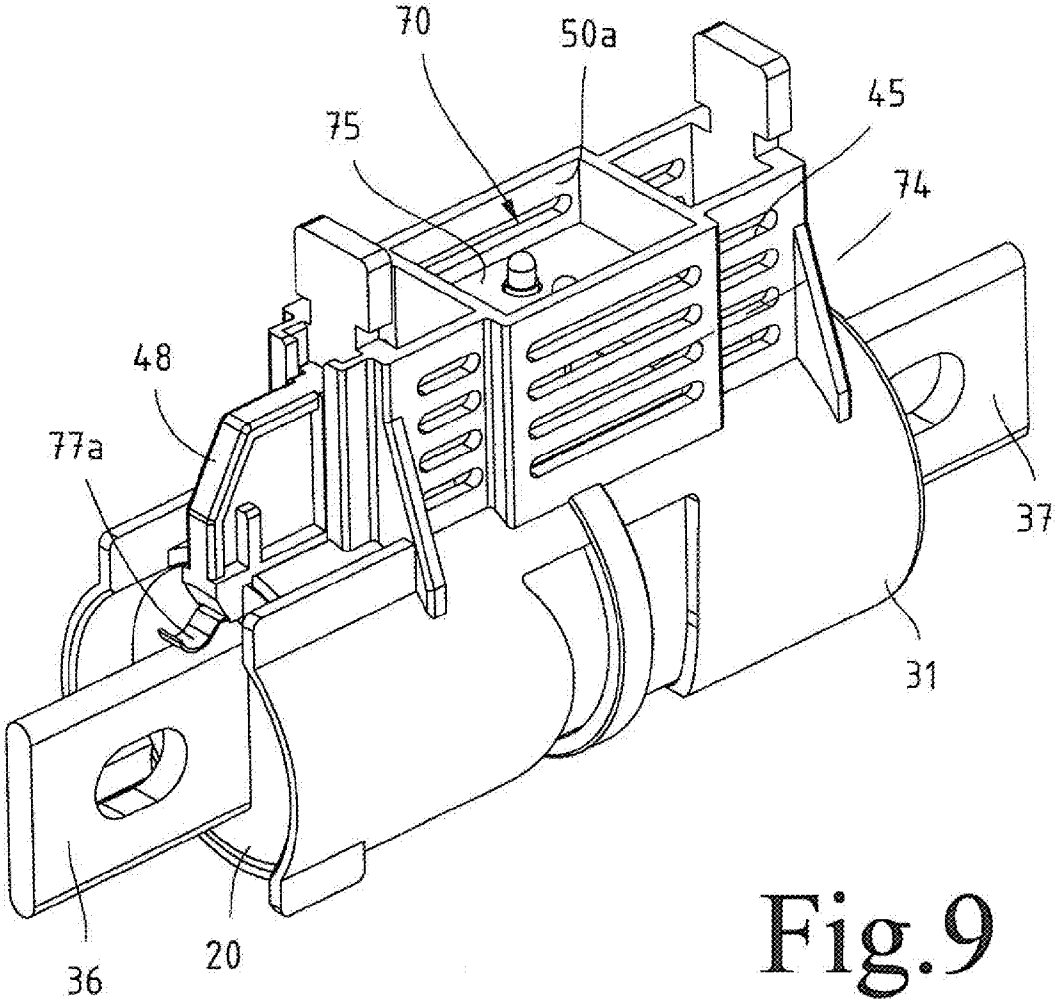
FIG. 9 is an illustration corresponding to FIG. 8 in explanation of the connecting contacts for the display means.

In FIGS. 8 and 9, a preferred embodiment of a bearing cage with a display means is shown.

The display means, designated by 70 below, is preferably located within the well 50*a* so that it is visible via the lid from the outside. Said display means 70 includes at least one lamp element 71, 72, preferably two LEDs 71, 72, which in the illustrated embodiment are attached to a printed circuit board 74 and project upwards in the well 50*a*. To cover the printed circuit board and to enclose the display lamps, a cover plate 75 is provided, which includes openings, not further designated, for leading through said display lamps 71, 72.

Figure 10:
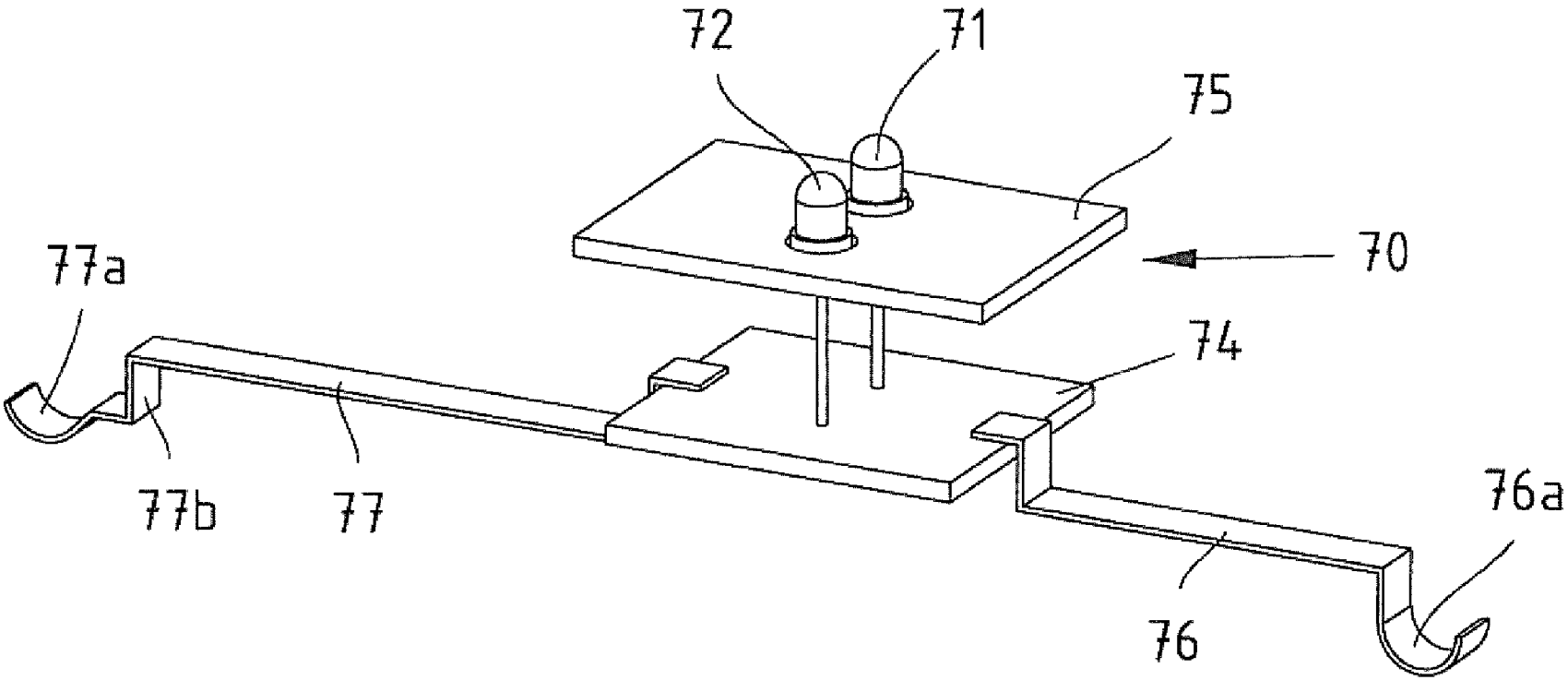
FIG. 10 is a perspective view of a preferred embodiment of a display means.

As shown in FIGS. 8 to 10, the shapes of the cover plate 75 and the printed circuit board 74 are preferably fit to the opening cross section 50 of the well 50*a*. Laterally bracing contacts 76, 77, which are preferably formed as spring contacts and support spring contact portions 76*a*, 77*a* at the free end, are arranged at the printed circuit board 74. According to FIG. 10, said contacts 76, 77 are laterally led out of the intermediate housing 45 so that the spring contact portions 76*a*, 77*a* can be brought into electrical contact with the associated contact blades 36, 37 of the inserted fuse. As can be seen in FIG. 10, said contacts 76, 77 substantially have the shape of a web extending substantially parallel to the axis of the bearing cage 31 above the cylindrical fuse 20. The contact 77 in front of the spring contact portion 77*a* comprises a contact portion 77*b* bracing approximately 90° downwards, which in a state of an inserted fuse 20 is overlapped by the locking means 48, if said locking means 48 takes the locking position shown in FIG. 10. In the preferred embodiment shown in FIGS. 8 to 10, a dual-diode system 71, 72 is provided for the purpose that one of both diodes 71, 72 lights up or flashes, if the inserted fuse 20 is defective. By using two light emitting diodes 71, 72, the display means can be used regardless of direction, i.e., one of both light emitting diodes 71, 72 lights up in case of a defective fuse 20 and regardless of the current flow.

Advantageously, the display means according to the invention can be optically checked or seen from the outside of the lid via a transparent or translucent cover 78 (FIG. 1) formed in the lid. According to the present invention, each bearing cage is provided with a display means 70. Thus, in a three-pole switch disconnector, all three fuses can be checked via the cover 78 by means of the respective display means.

The invention claimed is:

1. A switch disconnector comprising:

a housing portion, in which several pairs of blade receiving contacts assigned to each other are arranged, which can be bridged by means of fuses, one or more shock protection covers at least partially covering one or more contact blades, and a lid for receiving said fuses, which is provided in a manner hinged to said housing portion, wherein several receiving means in the form of slots or grooves are formed at the inside of said lid, further wherein one bearing cage is provided per each fuse, each bearing cage comprising a cage portion for insertion of a fuse, further wherein said cage portion is fitted to the shape of the fuse to be inserted, and each bearing cage is provided with fasteners, which are to be inserted in and snapped into predetermined receiving means, for fastening each bearing cage to said lid respectively, and wherein each bearing cage is arranged parallel to each other at the lower side of said lid.

2. The switch disconnector according to claim 1, wherein each cage portion is cylindrically formed.

3. The switch disconnector according to claim 1, wherein each cage portion comprises on one side an insertion hole and on the opposite side a boundary wall.

4. The switch disconnector according to claim 1, wherein each bearing cage comprises a boundary wall, which is provided with a slot for leading through a contact blade of a fuse.

5. The switch disconnector according to claim 1, wherein each bearing cage comprises a boundary wall having ventilation slots formed therein.

6. The switch disconnector according to claim 1, wherein each bearing cage comprises, in the area of an insertion hole, arm portions extended beyond said cage portion.

7. The switch disconnector according to claim 1, wherein said cage portion comprises an intermediate housing portion, at which fastening elements are arranged.

8. The switch disconnector according to claim 1, wherein said cage portion is provided with an intermediate housing portion comprising walls with ventilation slots.

9. The switch disconnector according to claim 1, wherein each bearing cage comprises an insertion hole and a locking means for fixing a fuse.

10. The switch disconnector according to claim 1, wherein said cage portion is provided with an intermediate housing portion proximate a locking means having a locking nose, said cage portion being adjustably supported in a guiding means provided at said intermediate housing portion.

11. The switch disconnector according to claim 1, wherein said cage portion is provided with a ring which is at least partially surrounding said cage portion, the outer diameter of which is larger than the outer diameter of said cage portion.

12. The switch disconnector according to claim 1, wherein each bearing cage comprises an intermediate housing portion having a well, into which a display means provided with contacts for contacting contact blades of the associated fuse is inserted.

13. The switch disconnector according to claim 1, wherein each bearing cage comprises an intermediate housing portion having a well, into which a display means provided with contacts for contacting contact blades of the associated fuse is inserted, further wherein said display means includes a printed circuit board having a LED means, wherein said contacts for electrical connection with said contact blades of the respective fuse are provided at said printed circuit board.

14. The switch disconnector according to claim 1, wherein each bearing cage comprises an intermediate housing portion having a well, into which a display means provided with contacts for contacting contact blades of the associated fuse is inserted, wherein said contacts include spring contact portions.

* * * * *